United States Patent [19]

Shreve, III

[11] Patent Number: 5,010,979

[45] Date of Patent: Apr. 30, 1991

[54] LADDER STABILIZING DEVICE

[76] Inventor: Arthur L. Shreve, III, P.O. Box 25, Butler, Md. 21023

[21] Appl. No.: 475,697

[22] Filed: Jan. 30, 1990

[51] Int. Cl.[5] ..... E06C 7/48

[52] U.S. Cl. ..... 182/214; 182/107

[58] Field of Search ..... 182/214, 107, 206; 248/210

[56] References Cited

U.S. PATENT DOCUMENTS

| | | | |
|---|---|---|---|
| 1,393,922 | 10/1921 | Taylor | 182/214 |
| 1,471,848 | 10/1923 | Johnson | 182/214 |
| 2,237,596 | 4/1941 | Eilers | 182/214 |
| 3,288,249 | 11/1966 | Gibson | 182/214 |
| 3,568,801 | 3/1971 | Werner | 182/214 |
| 4,061,203 | 12/1977 | Spencer | 182/214 |
| 4,331,217 | 5/1982 | Stecklow | 182/214 |
| 4,369,860 | 1/1983 | Beane | 182/214 |
| 4,502,566 | 3/1985 | Wing | 182/214 |
| 4,580,668 | 4/1986 | Morris | 182/107 |
| 4,823,912 | 4/1989 | Gould | 182/214 |

FOREIGN PATENT DOCUMENTS

| | | | |
|---|---|---|---|
| 629851 | 9/1949 | United Kingdom | 182/214 |

*Primary Examiner*—Reinaldo P. Machado

*Attorney, Agent, or Firm*—Charles F. Obrecht, Jr.

[57] ABSTRACT

An improved ladder stabilizing device for supporting a ladder a spaced distance away from a substantially vertical surface is disclosed. The device of the present invention includes a U-shaped support bar which forms two parallel legs, the ends of which rest against the substantially vertical surface. The support bar is attached to a leveling device consisting essentially of a U-shaped channel. The ends of the leveling device rest against the side rails of the ladder and the support bar engages the U-shaped channel. The leveling device and the support bar are simultaneously attached to the side rails of the ladder. The stabilizing device is easily removable and holds the ladder a distance from the substantially vertical surface to provide a safe angle of support.

6 Claims, 7 Drawing Sheets

LADDER STABILIZING DEVICE

BACKGROUND OF THE INVENTION

1. Field of the Invention

The invention relates to an improvement to an attachment to a ladder, for stabilizing a ladder a spaced distance from a substantially vertical surface.

2. Related Art

Ladder stabilizing devices are used in various forms to stabilize a ladder against substantially vertical surfaces such as walls of various structures by holding the ladder a spaced distance from the surface. The main use of such devices being depicted for use on residential homes to stabilize a ladder against outside walls, and adjacent to fragile surfaces such as windows, eaves, and rain spouts. See U.S. Pat. Nos. 4,502,566 and 4,823,912. Typically, the devices comprise a pair of support members attached to the side rails or rungs of a ladder. The means of attachment and the difficulty of attachment and removal vary. Some support members are attached to verticle support brackets by nuts and bolts. See U.S. Pat. Nos. 3,568,801 and 4,331,217. Some are attached to inverted U-shaped supports and vertically supported by chains (See U.S. Pat. Nos. 1,393,922 and 2,237,596), or the vertical support brackets and support members are made in one piece. (See U.S. Pat. No. 4,369,860 and British Patent Number 629,851). Usually, the vertical supports are attached to the ladder with brackets bolted around rungs (See U.S. Pat. No. 4,369,860) or are clamped to the side rails (See U.S. Pat. No. 4,502,566) or by channel brackets which fit over the outerrails of the ladder and are fastened snuggly by a threaded tie-rod extending between the brackets. (See U.S. Pat. Nos. 4,580,660 and 4,823,912). Some vertical supports are inverted U-shaped brackets which fit over two or more rungs of the ladder to provide for easy attachment and removal. (See U.S. Pat. Nos. 4,331,217 and 3,568,801).

All ladder stabilizing devices achieve their purpose of holding a ladder away from the vertical supporting surface in some fashion. Problems can arise however, with some devices which have their support members at right angles to the ladder rather than at right angles to the bearing surface, thus putting more strain in rotation on the connections between the supporting members at the ladder.

Other problems with these devices involve the number of parts to assemble; the difficulty of attaching and removing the device from the ladder; and the cost of manufacturing the entire assembly.

SUMMARY AND OBJECTS OF THE INVENTION

In view of the above described problems, it is an object of the invention to provide an improved ladder stabilizing device which is simple in its design, manufacture, assembly, and use.

It is a further object of this invention to provide an improved ladder stabilizing device which is easy to securely fasten to a ladder through the use of a leveling attachment, the ends of which rest against the side rails of the ladder and is mechanically attached to simultaneously engage the support member and the ladder at an angle which causes the support legs to rest at right angles to the bearing surface when the ladder is placed at the OSHA recommended angle of 75½° from the vertical.

It is a further object of this invention, to provide an improved ladder stabilizing device through the use of a leveling attachment that can be attached to and used in conjunction with other types of ladder attachments and other ladder stabilizing devices to provide the same right angle support between the support legs and the bearing surface.

The above objects of this invention are accomplished with a leveling attachment extruded in plastic or metal, or cast or fabricated to create a horizontal channel into which the support member of the same or similar shape is inserted and securely clamped, bolted, or pinned. The leveling attachment has a channel, the sides of which can be 75½° from the vertical, so the support member can be engaged at such angle to allow the support member to rest at right angles to the bearing surface when the ladder is placed at the OSHA recommended angle. The leveling attachment can be easily attached to other types of ladder stabilizing or standoff devices whose support members can fit into the channel and fastened. The leveling attachment and support member assembly can also be securely attached to other ladder attachment devices.

DETAILED DESCRIPTION OF THE PREFERRED EMBODIMENTS

Figure 1:
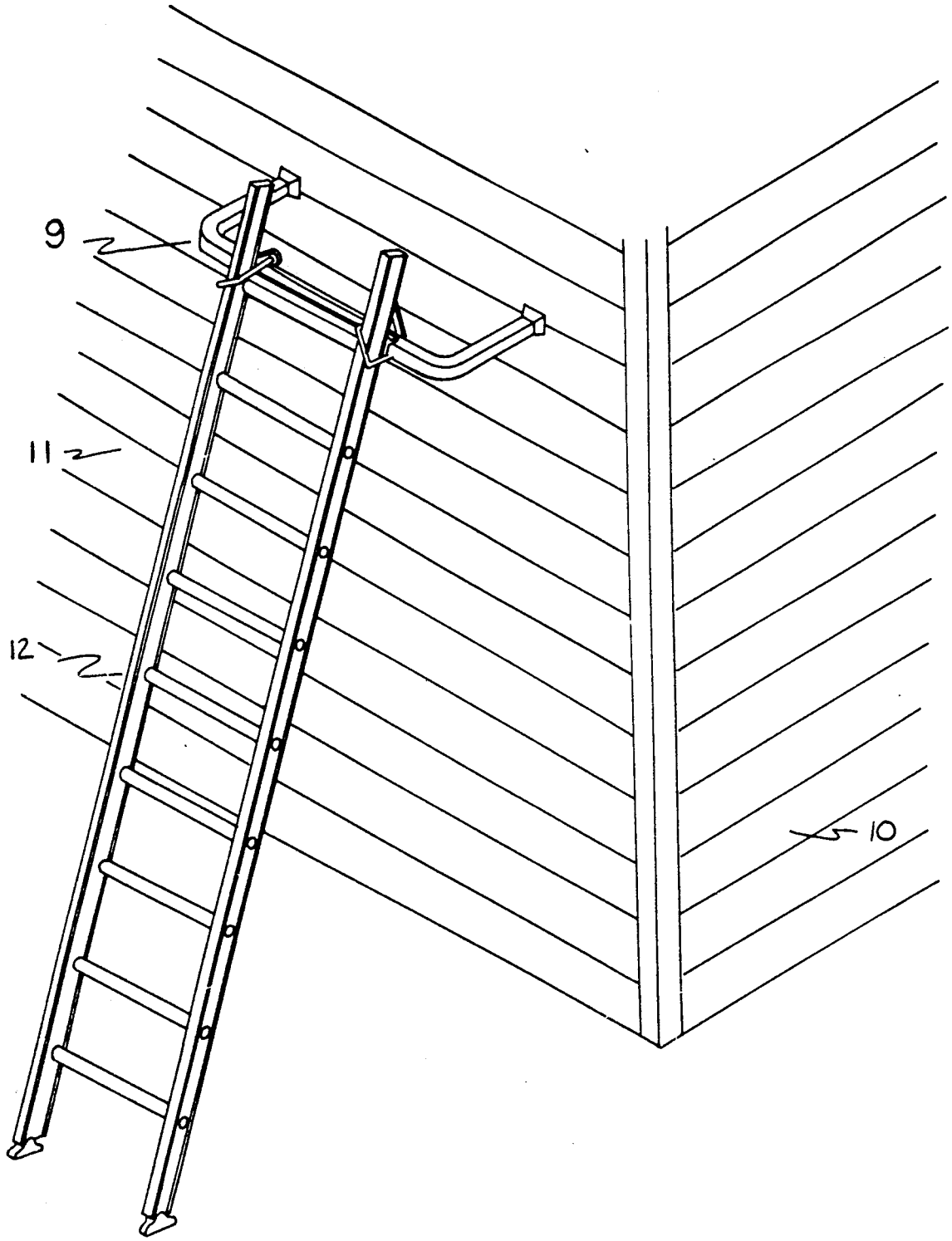
FIG. 1 is a perspective view of one embodiment of the ladder stabilizing device of the present invention attached to the rungs of a ladder.

FIG. 1 shows a ladder 12 leaning against a wall 11 of a building 10, with the present invention generally designated by the number 9, attached to the side rails 13 of the ladder.

Figure 2:
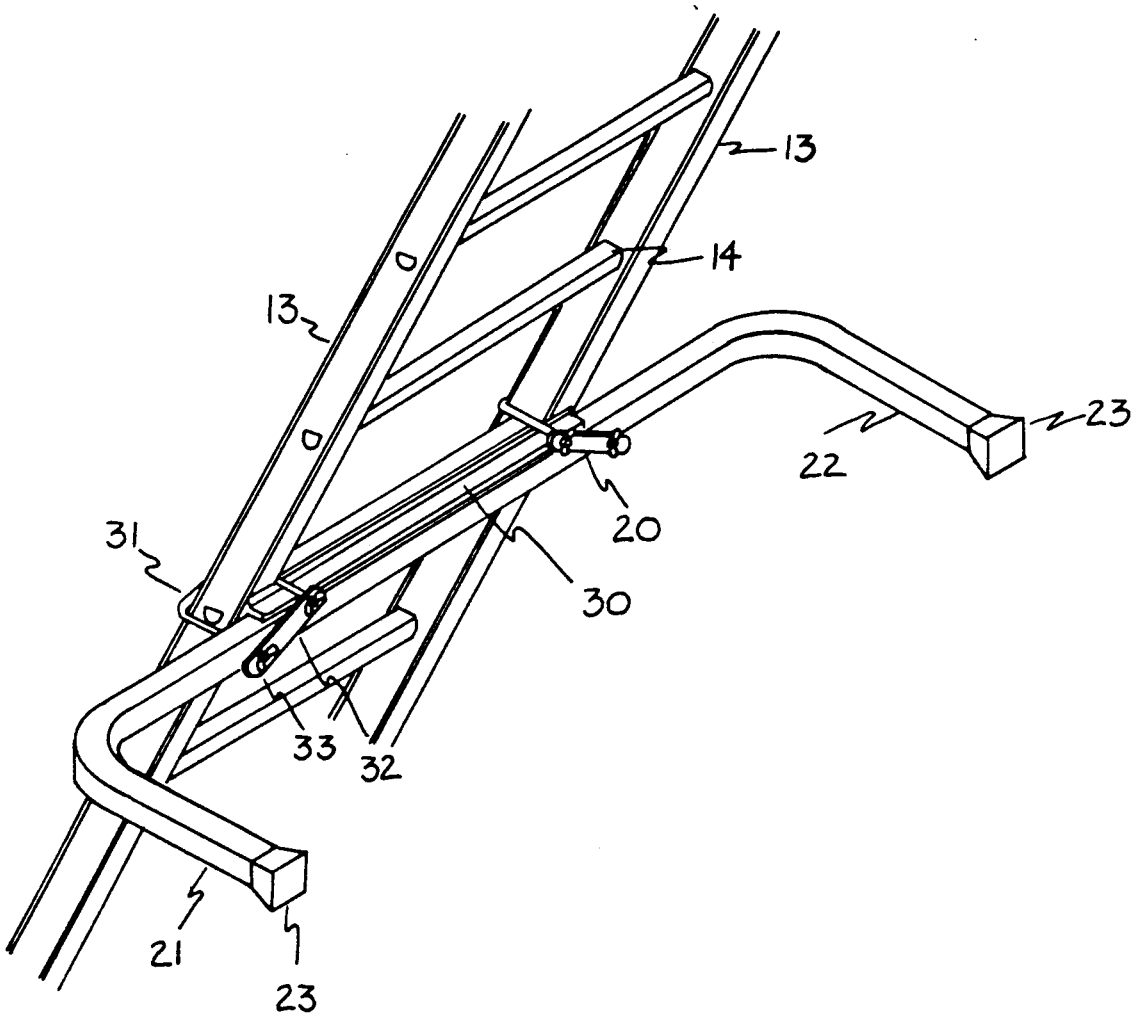
FIG. 2 is a perspective view of the preferred embodiment invention attached to the side-rails of a ladder.

FIG. 2 shows the support bar 20 which stabilizes the ladder 12, inserted into the leveling attachment 30 which in turn is attached to the side rails 13 of the ladder 12 by U-bolts 31 and fastened with plates 32 and wing nuts 33.

Figure 3:
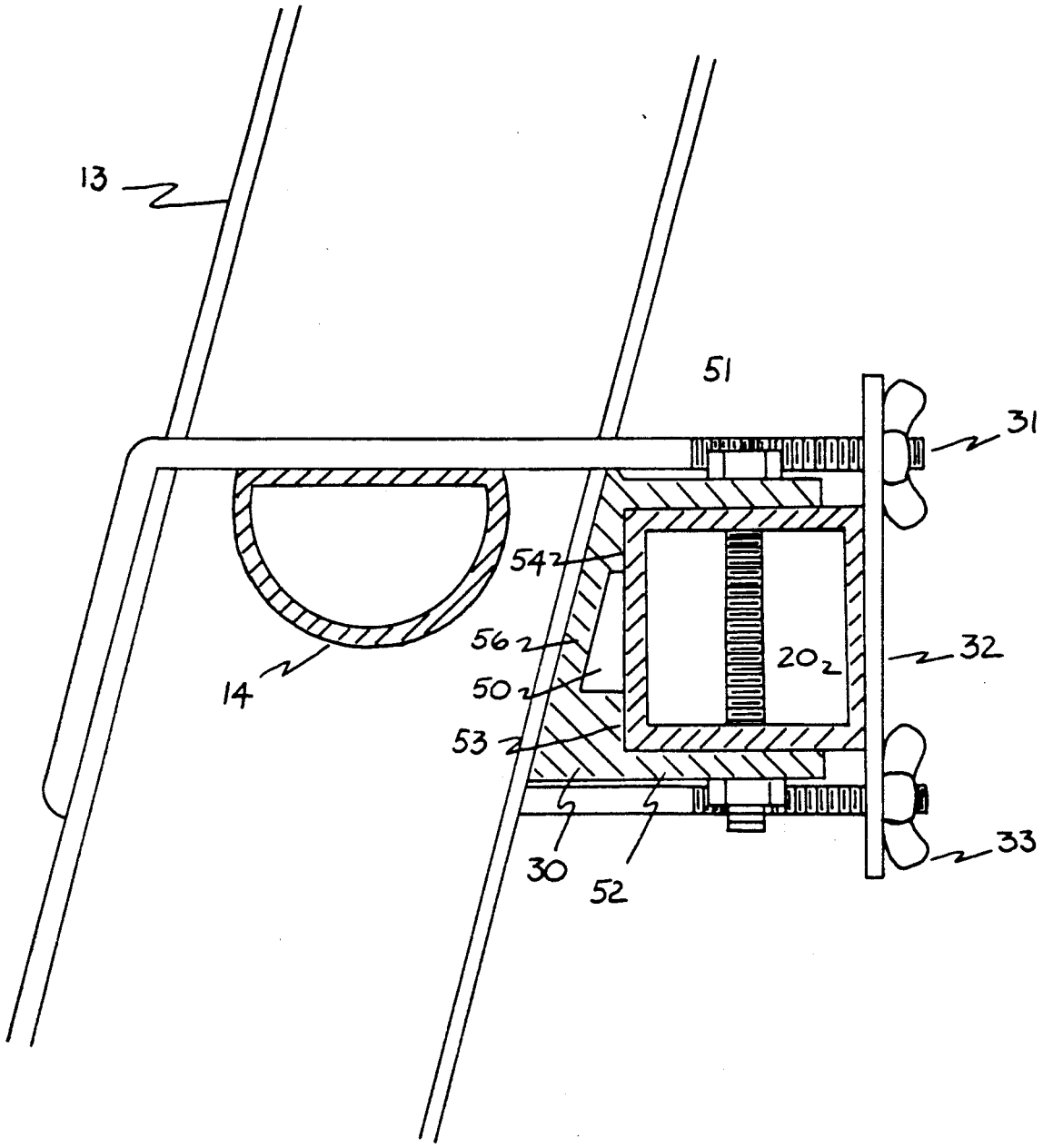
FIG. 3 is detailed side view of the preferred embodiment of the invention attached to the side-rails of a ladder.

Referring to FIG. 2, which shows the preferred embodiment of the invention, the support bar 20 may be formed as a hollow square tubular structure, the end portions of which are bent at right angles to form opposite parallel support legs 21 and 22. The ends of the support legs 21 and 22 rest against the substantially vertical wall 11 at right angles thereto. Protective end caps 23 can be attached. The right angle is accomplished with the leveling attachment 30, which is extruded in plastic or metal, or cast from plastic or metal or fabricated from bent shapes and forms of metal or plastic and assembled in any combination of components, to achieve the integral shape, angle, and form as shown in FIGS. 3, 4, and 5.

Figure 4:
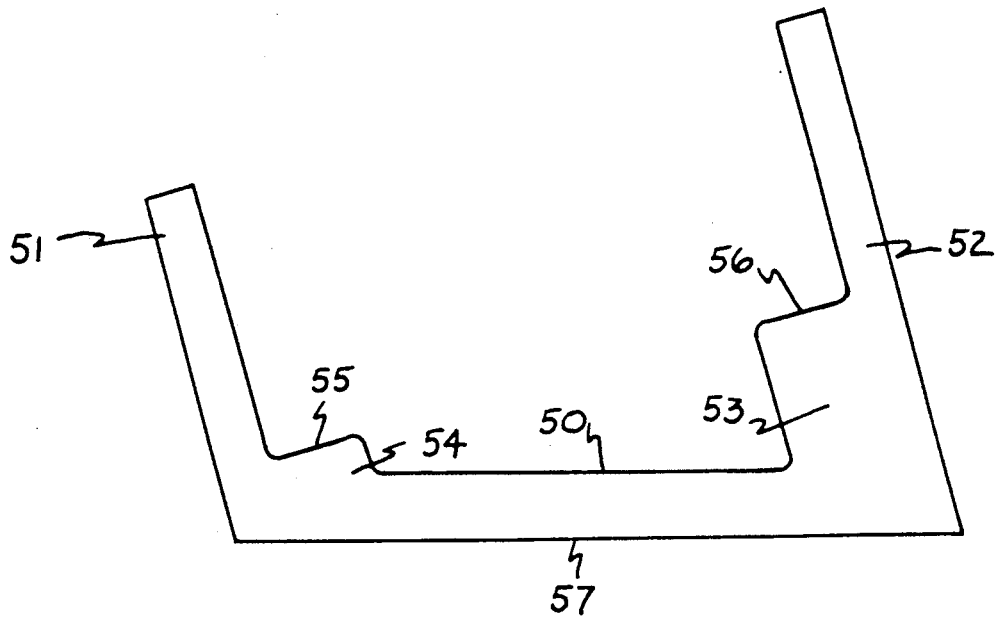
FIG. 4 is a side view of the preferred embodiment of the leveling enlarged to double its actual size.

The leveling attachment 30 is formed as above into a channel, the sides 51 and 52 of which, as shown in FIG. 4, are angled at 75½° from the inside base 50 and outside base 51. At the intersection of each side 51 and 52 and, the inside base 50, steps 53 and 54 are formed to create shoulder surfaces 55 and 56. The shoulder surfaces are on the same plane forming right angles with the sides 51 and 52. The support bar rests on the shoulder surfaces 55 and 56 and the support legs 21 and 22 then extend, as extensions of the sides 51 and 52 of the channel. Thus, when the outside base 57 of leveling attachment is clamped to the rails 13 of the ladder 12, the support legs 21 and 22 extend from the plane of the side rails 13 at an angle of substantially 75½°. When the ladder 12 is placed at the OSHA recommended angle of 75½° from the vertical, the support legs 13 will rest at right angles to the vertical wall 11.

The support bar 20, after insertion into the channel of the leveling attachment 30, is firmly held in place with the U-bolts 31. The U-bolts 31 are attached to side rails 13 of the ladder 12 such that one leg thereof extends over a rung 14 and on the inside rail 13 and over the leveling attachment 30, while the other leg of U-bolt 31 extends on the outside of rail 13 and under the leveling attachment 30 and support bar 20. Plates 32 containing holes aligned to accept the threaded ends of the U-bolts 31, are placed over the support bar 30 which is fittingly engaged into the channel of the leveling attachment 30 such that support bar 20 is bound securely therein. The plates 32 are secured over the support bar by the wing nuts 33. Thus, the invention 9 is secured firmly and safely to the ladder 12, without the use of special tools.

Figure 5:
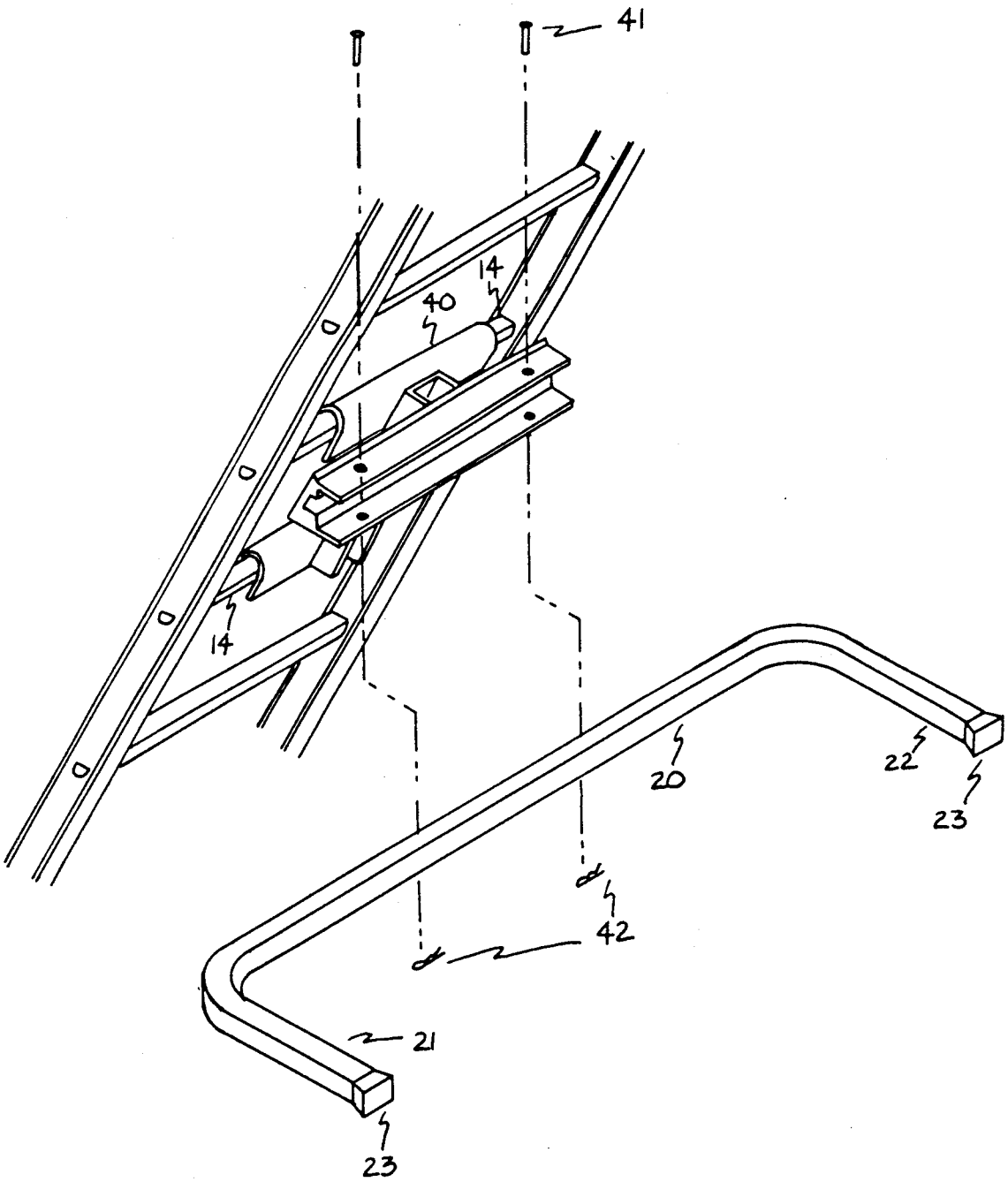
FIG. 5 is partially exploded view of the leveling attachment of the preferred embodiment of the present invention connected to an existing ladder attachment.

Another embodiment of the invention is shown in Figure 5 where the support bar 20 and leveling attachment 30 are fastened together with two retaining pins 41 inserted through both the support bar 20 and leveling attachment 30 which contain aligned holes. The assembly can then be welded, bolted, or by some other means not shown, attached to any well known ladder attachment which, in this embodiment, consists of inverted tubular portions 40 which fit over the adjacent upper and lower rungs 14 of ladder 12. Thus, the apparatus in this embodiment is easily and quickly installed and removed and the OHSA recommended angle of the ladder 12 is maintained.

Figure 6:
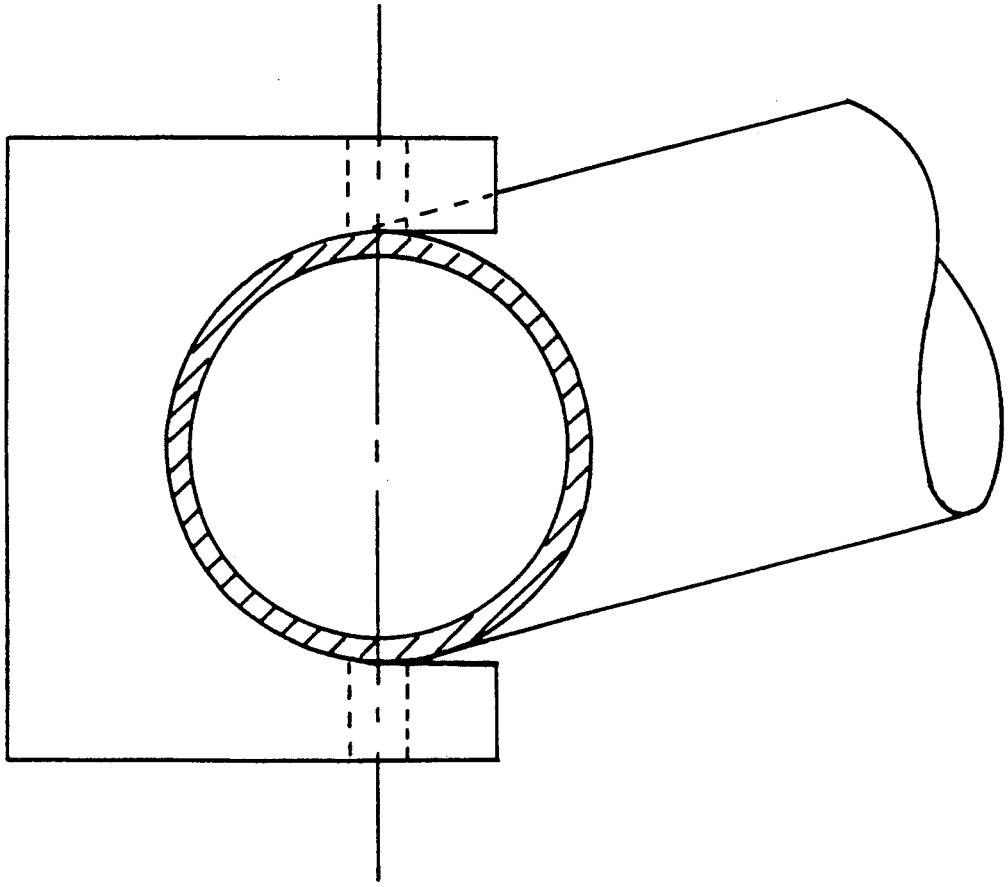
FIG. 6 is the side view of another embodiment of the leveling attachment wherein the leveling attachment accepts a round support bar at a 75½° angle.

Referring to FIG. 6, an embodiment of the leveling attachment is shown to accept a circular support bar. The leveling attachment is formed such that the sides of the channel are at right angles to the base, and the right angle between the support legs at the vertical wall 11, is achieved by attacheding the support bar such that the support legs create a 75½° angle with the base of the leveling attachment.

Figure 7:
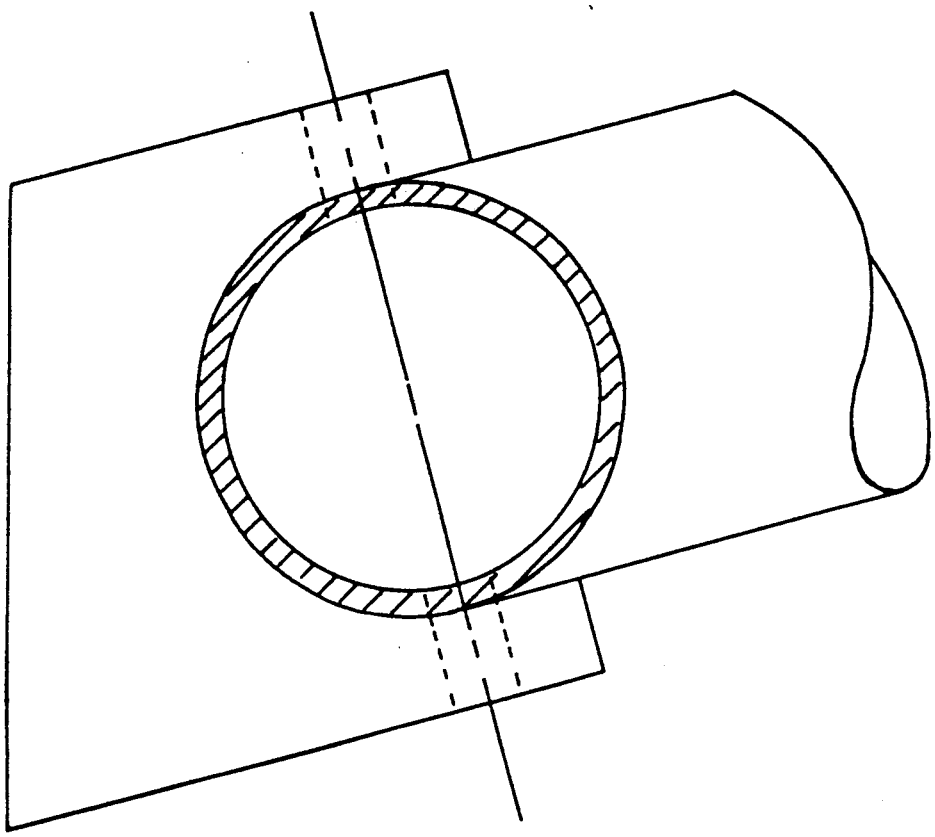
FIG. 7 is the side view of a leveling attachment wherein the leveling attachment accepts a round support bar parallel to the sides of the improved leveling attachment.

FIG. 7 shows another embodiment wherein the leveling attachment is shown to accept a circular support bar. The leveling attachment is formed such that the sides of the channel are at an angle of 75½° from the base and the right angle between the support legs and the vertical wall 11 is achieved by attaching the support bar such that the support legs are parallel to the sides of the leveling attachment.

While four embodiments of the invention have been described, it will be understood that it is capable of further modification, and this application is intended to offer any variations, uses or adaptations of the invention, following, in general, the principles of the invention and including such departures from the present disclosures as to come within knowledge or customary practice in the art to which this invention pertains, and as may be applied to the essential features hereinbefore set forth and falling within the scope of the invention or the limits of the appended claims.

I claim:

1. An improved ladder stabilizing device for supporting a ladder adjacent to a substantially vertical surface, of the type in which a ladder having a pair of generally parallel side rails connected by a plurality of transverse ladder rungs therebetween, is held by a first supporting means for supporting said ladder at a spaced distance from the said surface, and a second supporting means for removably clamping said first means to said ladder, and a third supporting means, wherein the improved third supporting means comprises:

a generally U-shaped member having parallel opposing sides positioned at oblique angles to a bottom of said member, an inside of said U-shaped member being shaped to receive and substantially engage and hold the said first supporting means parallel to the sides of the third supporting means and at right angles to the said vertical surface.

2. The improved ladder stabilizing device is in claim 1 wherein the inside of said U-shaped member has a shape to fittingly engage the first supporting means.

3. The improved ladder stabilizing device as in claim 1 wherein the inside of the U-shaped member has a shape comprising:

the parallel opposing sides positioned at an oblique angle to a bottom of said member each said side having an inwardly directed step, the steps forming inner shoulder surfaces, the surfaces being in the same plane and perpendicular to the parallel sides of said U-shaped member, the U-shaped member receiving and surrounding three sides of said first supporting means and holding the first supporting means parallel to the sides of the third supporting means and at substantially right angles to the said vertical surface.

4. The improved ladder stabilizing device as in claim 3 comprising means for immovably attaching the first supporting means to the third supporting means.

5. The improved ladder stabilizing device as in claim 4 wherein the means for attaching comprises pins inserted through aligned holes in the first and third supporting means and held in place with securing means.

6. The improved ladder stabilizing device as in claim 5 wherein the securing means comprises clips removably inserted through transverse holes in the ends of the pins.

* * * * *